US005377833A

United States Patent [19]

Ranger

[11] Patent Number: 5,377,833

[45] Date of Patent: Jan. 3, 1995

[54] BEVERAGE CONTAINER HOLDER

[76] Inventor: Celeste A. Ranger, 1184 Glendale, Burton, Mich. 48509

[21] Appl. No.: 129,451

[22] Filed: Sep. 29, 1993

[51] Int. Cl.[6] ..... B65D 75/00

[52] U.S. Cl. ..... 206/430; 206/427; 206/806; 383/38

[58] Field of Search ..... 206/427, 430, 806; 383/39, 38

[56] References Cited

U.S. PATENT DOCUMENTS

| | | | |
|---|---|---|---|
| 2,078,438 | 4/1937 | Baxter . | |
| 2,154,510 | 4/1939 | King et al. . | |
| 2,405,517 | 8/1946 | Plummer | 383/39 X |
| 2,413,580 | 12/1946 | Perry . | |
| 2,473,429 | 6/1949 | Hinman | 383/39 X |
| 2,517,757 | 8/1950 | Alderstein | 383/38 X |
| 2,533,850 | 12/1950 | Syracuse | 383/38 X |
| 2,684,097 | 7/1954 | Trevl | 383/38 |
| 3,088,652 | 5/1963 | Berven . | |
| 3,411,697 | 11/1968 | Hightower | 206/427 X |
| 4,101,025 | 7/1978 | Jordan | 383/39 X |
| 4,234,086 | 11/1980 | Dorton . | |
| 4,542,826 | 9/1985 | Adams | 206/427 |
| 4,706,805 | 11/1987 | Becher | 206/427 X |
| 4,738,363 | 4/1988 | Hudson | 206/427 |
| 4,789,248 | 12/1988 | Penas . | |
| 4,871,067 | 10/1989 | Valenti | 206/427 |
| 5,046,860 | 9/1991 | Brennan | 383/39 X |
| 5,190,377 | 3/1993 | Kelly | 383/39 X |

FOREIGN PATENT DOCUMENTS

| | | | |
|---|---|---|---|
| 0441860 | 1/1936 | United Kingdom | 383/38 |

*Primary Examiner*—Paul T. Sewell
*Assistant Examiner*—Ted Kavanaugh
*Attorney, Agent, or Firm*—Learman & McCulloch

[57] ABSTRACT

A device for holding and storing emptied beverage containers includes a bag having a plastic back panel and a transparent plastic front panel secured to the back panel at the opposite sides and bottom edges and at laterally spaced zones across the width of the bag to form a plurality of parallel, vertically extending pockets. The tops of the pockets are open for receiving containers in an upright end-to-end stacked relationship. The bottoms of the pockets are closed. A rip cord associated with each of the pockets is operable in response to the application of tensile force thereon to cause the pocket to tear along the length of the pocket, thereby enabling the discharge of the containers from the pockets. The bag may be removably supported on a hanger which in turn may be supported on a door, wall, or other structure.

14 Claims, 1 Drawing Sheet

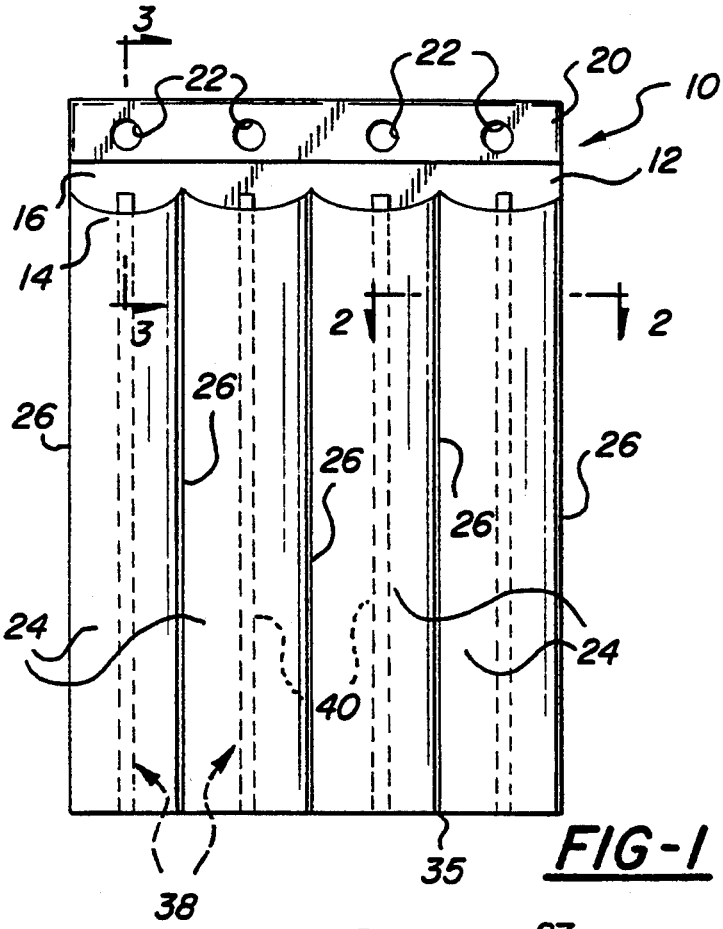
FIG-1
FIG-2
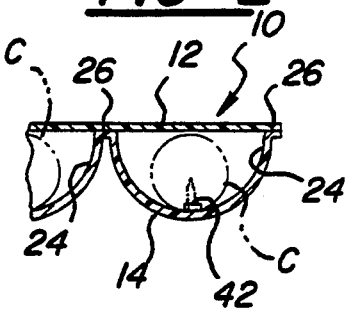
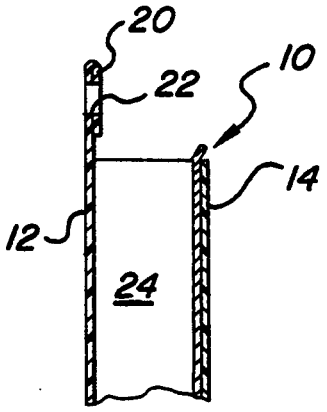
FIG-3
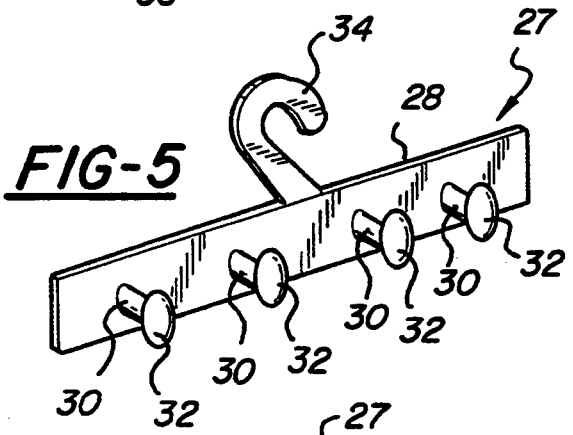
FIG-5
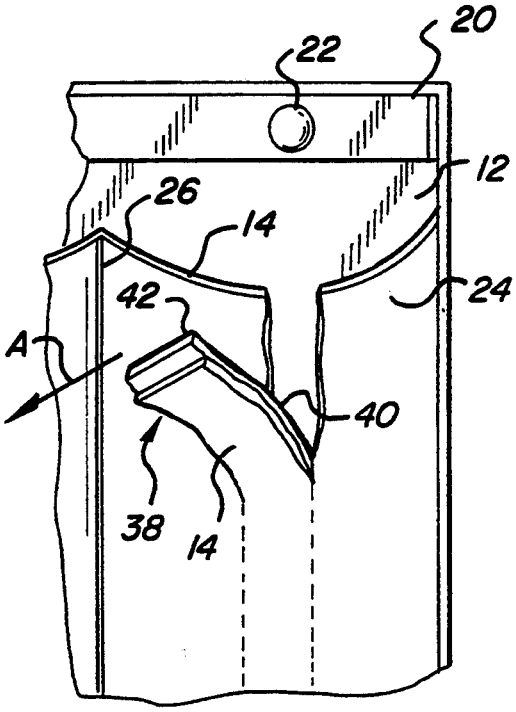
FIG-4
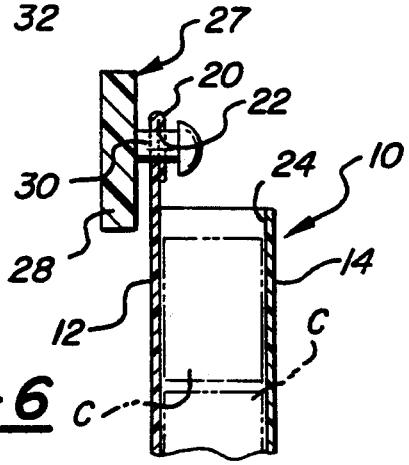
FIG-6

BEVERAGE CONTAINER HOLDER

This invention relates generally to a device for holding and storing emptied returnable beverage containers and more particularly to such a device having multiple pockets for accommodating a plurality of such containers.

BACKGROUND OF THE INVENTION

Several states have laws requiring purchasers of soft drinks and other beverages to pay a deposit on their containers. The deposit is refunded when the purchaser returns the container to the store of purchase. It is economically sensible, therefore, for the consumer to store and return empty containers.

Many people store emptied containers in paper bags. Quite often not all of the contents of each container are drained and it sometimes happens that the partially emptied containers will be overturned in the bag causing the bottom of the bag to become saturated and weakened with the result that lifting of the bag may cause it to break, scattering the contents.

Some persons store empty containers in plastic, moisture proof bags to prevent the saturation and weakening associated with paper bags. In many instances, however, the store or other recipient of empty containers will not accept plastic bags because of the difficulty and inconvenience in counting and verifying returnable containers.

SUMMARY OF THE INVENTION

A device for holding and storing emptied returnable beverage containers comprises a bag member having confronting front and back panels extending lengthwise between the top and bottom ends of the bag member. The panels are joined at laterally spaced locations across the width of the bag member to define a plurality of elongate pockets of suitable size for accommodating a plurality of such containers in each pocket. The top end of each pocket is open for receiving the containers. The bottom of each pocket is sealed to prevent leakage of liquids through the bottom. Each pocket has access means extending from top to bottom to enable each pocket to be opened for discharge of the containers from the pockets.

The device enables returnable beverage containers to be stored in a neat and orderly manner before returning them to the place of purchase. The open top enables easy top loading of the containers into the pockets for storage. The multiple pockets not only permit multiple containers to be stored, but also enables them to be separated into appropriate categories. Each pocket normally is closed, except at its upper end, to retain the containers in the pockets, but is readily opened by operation of the access means to discharge the emptied containers from the pockets at the collection facility. The vertical, spaced pockets facilitate storing of the containers in the upright condition, thereby minimizing spillage of any contents remaining in the stored containers. The construction of the storage bag also minimizes the need for direct physical contact with containers during their discharge at the collection facility. The device also provides a convenient receptacle for transporting emptied containers to the collection facility.

THE DRAWINGS

A presently preferred embodiment of the invention is illustrated in the accompanying drawings, wherein:

FIG. 1 is a front elevational view of the bag member;

FIG. 2 is a sectional view taken along the line 2—2 of FIG. 1;

FIG. 3 is a sectional view taken along the line 3—3 of FIG. 1;

FIG. 4 is an enlarged, fragmentary, isometric view illustrating the operation of the pocket access means;

FIG. 5 is an isometric view of a hanger for supporting the bag of FIG. 1; and FIG. 6 is a fragmentary sectional view showing the bag supported by the hanger.

DETAILED DESCRIPTION

A device for holding and storing emptied returnable beverage containers constructed in accordance with a presently preferred embodiment of the invention is illustrated in the drawings and comprises a bag member 10 having a back panel 12 and a front panel 14 which overlies the back panel. The bottom ends of the back and front panels are coplanar, but the upper end of the front panel terminates short of the upper end of the back panel to provide an extension 16 of the latter. The back panel 12 is formed of flexible plastic sheet material and preferably includes a reinforced strip 20 at its upper end that projects beyond the extension 16 and spans the width of the back panel. A plurality of apertures 22 are provided in the strip 20 for a purpose to be described. The reinforced strip 20 may comprise a double layer of the back panel material formed by folding the top of the back panel 12 back upon itself and then securing the folded over portion to the back panel 12 along the free edge of the folded over portion and preferably around the perimeter of the apertures 22 by heat sealing or other suitable means. The back panel 12 preferably is thicker or otherwise more durable than the front panel.

The front panel 14 is secured to the back panel 12 along opposite side edges and at laterally spaced zones across the width of the bag thereby forming a plurality of elongate, sleeve-like pockets 24 extending lengthwise between the top and bottom ends of the bag member 10. The secured portions form seams 26 separating the pockets 24 into individual adjacent compartments.

The front panel 14 is formed of flexible polyethylene or other suitable plastic sheet material and preferably is transparent to enable easy identification of the quantity and type of contents in each pocket 24. The top of each of the pockets 24 is open to enable containers C to be inserted into each of the pockets 24. The front panel 14 is initially considerably wider than the back panel 12 so that the pockets 24 have a generally semi-circular cross-sectional configuration, as illustrated in FIG. 2. The semi-circular configuration of the pockets 24 enables them to accommodate containers of various diameters. Each of the pockets 24 is of suitable size for accommodating a plurality of emptied returnable beverage containers C, such as 12-ounce soda or beer cans, in an upright stacked manner. The walls of each pocket 24 support the containers C laterally to maintain their upright positions in the pockets 24.

The device preferably includes a hanger member indicated generally at 27 in FIG. 5 for detachably mounting the bag member 10 on a support. The hanger member 27 includes a bar 28 having a length approximating the width of the bag member 10. A plurality of support pegs 30 are secured to the bar 28 at laterally spaced intervals corresponding to the spacing of the apertures 22 and project outward from the front face of the bar 28. Each peg terminates in an enlarged head 32. The pegs 30 are insertable through the apertures 22 in the manner shown in FIGS. 6, with the enlarged heads 32 serving to retain the bag member 10 against inadvertent separation from the bar 28. A hook 34 is secured to the bar 28 midway between the ends thereof to enable the bar and the bag member 10 to be hung from a door, wall, or other suitable support structure with the top end of the bag member uppermost. The hanger member 27 may be formed from any one of a number of different materials such as rigid plastic or metal, and may be formed as one integral piece or as multiple components.

The front and back panels 14, 12 also are joined along their bottom edges by a seam 35 formed by heat sealing or other sealable means. The bottom seam 35 and pocket seams 26 render the plastic bag member 10 fluid tight to retain any contents that may have spilled from the container C. Unlike paper, the plastic bag material maintains its strength and integrity when wet.

The front panel 14 is provided at each of the pockets 24 with access means 38 which normally maintains the pockets closed to retain the containers C in the pockets during storage, but which enables each of the pockets to be opened upon the application of a force to the associated access means 38 to enable discharge of the containers C from the pockets 24.

The preferred construction of the access means 38 comprises a separable rip cord or tear strip 40 which is adhered to an inside surface of the front panel 14 between adjacent seams 26 and extends the full height of the front panel as illustrated in FIGS. 1 and 4.

The upper end of each rip cord 40 extends beyond the upper edge of the front panel 14 presenting a tab 42 which may be grasped by a person desiring to open the associated pocket. The rip cord 40 is fabricated preferably of a tough plastic or flexible material having a tensile strength greater than that of the front panel 14 so that when pulled on, the front panel 14 and not the rip cord 40 yields. The preferred material for the front panel 14 also has a directional grain structure such that as a result of the forming process, the molecular structure of the material is aligned axially in the direction of forming. Preferably, the front panel 14 is oriented such that the directional grain structure extends vertically of the bag member and each rip cord 40 extends in the same direction as the grain structure.

To open any one of the pockets of the bag member 10, one may simply pull on the tab 42 of the associated rip cord 40 applying tensile force in the direction of arrow A in FIG. 4 causing the front panel 14 to sever or tear on each side of the rip cord 40 and along the length of the rip cord as illustrated in FIG. 4, thereby separating the rip cord 40 from the bag member 10 and opening the associated pocket 24 to enable discharge of the containers C therefrom.

A user of the disclosed device may store the emptied containers C in the multiple pockets 24 of the bag member 10 until such time as the pockets are full. Each of the pockets is designed to store a plurality of such containers in an upright stacked manner until it is convenient to return them to a collection facility. Once the pockets are filled, the user may simply unhook the bag member 10 from the hanger 27 and return the bag member 10 along with its contents to the store of purchase to receive the refundable deposit for the containers C. An attendant readily may determine the number and type of containers in each pocket 24 without having to remove the containers as a result of the provision of the transparent front panel 14. The attendant then may quickly and efficiently discharge the containers into their appropriate collection bins by opening the pockets 24 via the rip cords 40 without having to touch the containers C. The spent bag member 10 may then be retained by the collection facility for recycling or disposal and a new one obtained.

Although the access means 38 described above does not require perforating the front panel 14, thereby retaining the moisture proof nature of the pockets 24, it is possible to perforate or weaken the panel 14 adjacent each rip cord to facilitate opening of the pockets.

The disclosed embodiment is representative of a presently preferred form of the invention, but is intended to be illustrative rather than definitive thereof. The invention is defined in the claims.

I claim:

1. A device for storing containers comprising: a bag member having opposed front and back panels extending lengthwise between top and bottom ends of said bag member, said panels being joined at their bottom and opposite edges and at laterally spaced zones across the width of said bag member to define a plurality of elongate pockets extending between said top and bottom ends, each of said pockets being of suitable size for accommodating a plurality of such containers therein, each of said pockets being open at its upper end to enable the introduction thereto of containers, each of said pockets being closed except at its upper end, said pockets having a rip cord secured to and extending longitudinally of at least one of said panels, whereby the application of an opening force to an end of said rip cord causes said one of said panels to tear along the length of said rip cord thereby opening the associated pocket.

2. The device of claim 1 wherein said one of said panels has a directional grain structure extending longitudinally of said pockets, each of said rip cords extending in the direction of said grain structure.

3. The device of claim 1 wherein said panels are joined by seams that provide a fluid tight seal to said opposite and bottom sides of said bag.

4. The device of claim 1 wherein said pockets support the containers upright within said pockets.

5. The device of claim 1 wherein at least said front panel of said bag is formed of transparent material.

6. The device of claim 1 wherein said one of said panels is less durable than the other of said panels.

7. The device of claim 1 wherein said front panel initially is greater in width than said back panel so that each of said pockets has a generally semi-circular cross-sectional configuration.

8. The device of claim 1 including detachable hanger means for detachably hanging said bag member on a support.

9. The device of claim 8 wherein said hanger means includes at least one aperture in and adjacent said top end of said bag member, and a support peg carried by said hanger means for removable accommodation in said aperture.

10. The device of claim 9 wherein said hanger means includes a rigid bar on which said support peg is mounted.

11. A device for storing returnable beverage containers comprising: a plastic bag member having a back panel and a front panel extending between opposite top and bottom ends of said bag member, said panels being flexible and joined at their opposite side and bottom edges and at laterally spaced zones across the width of said bag member to form a plurality of elongate pockets extending lengthwise of said bag member between said top and bottom ends, each of said pockets being open at its upper end to provide access to each of said pockets, each of said pockets being of suitable size for accommodating a plurality of such containers therein, said front panel being constructed from transparent material to enable identification of the number and type of containers in each pocket, and a separable rip cord for each of said pockets and secured to one of said panels and extending longitudinally of each of said pockets adjacent said one of said panels, each of said rip cords being operable in response to the application of a force thereon to cause said one of said panels to tear along the length of the associated pocket thereby enabling discharge of the containers from said pockets.

12. The device of claim 11 wherein said one of said panels has a directional grain structure extending longitudinally of said pockets, each of said rip cords extending in the direction of said grain structure.

13. The device of claim 11 including hanger means for supporting said bag member with said top end uppermost.

14. A device for storing containers comprising: a bag member having opposed front and back panels fabricated of flexible plastic material extending lengthwise between top and bottom ends of said bag member, said panels being permanently joined at their bottom and opposite edges and at laterally spaced zones across the width of said bag member to define a plurality of elongate pockets extending between said top and bottom ends, each of said pockets being of suitable size for accommodating a plurality of such containers therein, each of said pockets being open at its upper end to enable the introduction thereto of containers, each of said pockets being closed except at its upper end, each of said pockets having access means enabling said pockets to be opened in response to the application of an opening force on said access means, thereby enabling discharge of the containers from said pockets, said access means comprising a rip cord secured to and extending longitudinally of each of said pockets, whereby the application of said opening force to an end of and one of said rip cords causes the associated one of said panels to tear along the length of said rip cord thereby opening the associated pocket.

* * * * *